US006416371B1

(12) United States Patent
Johnson

(10) Patent No.: US 6,416,371 B1
(45) Date of Patent: Jul. 9, 2002

(54) PROPELLER DEFLECTOR

(76) Inventor: Donald C. Johnson, P.O. Box 1204, Duluth, County of Gwinnett, GA (US) 30136-1204

( * ) Notice: Subject to any disclaimer, the term of this patent is extended or adjusted under 35 U.S.C. 154(b) by 0 days.

(21) Appl. No.: 09/635,499

(22) Filed: Aug. 9, 2000

(51) Int. Cl.[7] ..... B63B 59/02; B63H 5/16
(52) U.S. Cl. ..... 440/71; 114/219
(58) Field of Search ..... 440/1, 56, 71; 114/140, 219

(56) References Cited

U.S. PATENT DOCUMENTS 1,595,949 A * 8/1926 Kirin ..... 440/48
1,869,977 A * 8/1932 Modin ..... 440/71
2,124,497 A * 7/1938 Slauson ..... 114/219
3,595,190 A * 7/1971 Lapworth ..... 114/9
3,805,723 A * 4/1974 Bernaerts ..... 114/338
4,088,091 A * 5/1978 Smith ..... 440/69
4,352,335 A * 10/1982 Sugden ..... 114/143
4,428,735 A * 1/1984 Gruzling et al. ..... 440/76

* cited by examiner

*Primary Examiner*—S. Joseph Morano
*Assistant Examiner*—Andy Wright

(57) ABSTRACT

A propeller deflector system which includes rigid inclined vanes permanently mounted on the bottom of a hull of a water craft and aligned parallel with the longitudinal axis of the water craft. The vanes extend below a propeller and beyond an arc of the propeller. The propeller deflector system also includes a sensing device adapted to detect objects in water near a path of the water craft. The propeller deflector system is designed to prevent loss of human and animal life in the propeller.

6 Claims, 2 Drawing Sheets

PROPELLER DEFLECTOR

BACKGROUND

The need for a propeller deflector was established as a response to observations and discussions regarding the number of fatalities and serious injuries to both human and animal life caused by contact with marine propellers. Substantial monetary costs and personal suffering are incurred through these instances. The propeller deflector was invented to reduce the losses of life, limb and property and the monetary damages associated with those losses.

1. Field of the Invention

The propeller deflector is a manufactured item.

2. Description of Related Prior Art

There is no known prior art relative to this application. Though several items concerning propeller protection were examined, diligent search of the patent records failed to reveal any items whereby subjects that may have been harmed or injured were directed away from the water craft and out of range of the spinning propeller by means of a solid vane structure mounted directly to the bottom of the hull of said water craft.

SUMMARY OF THE INVENTION

A propeller deflector is a system of rigid vanes mounted to the bottom of the hull of a boat. This structure directs objects such as humans, marine life and debris from making contact with the spinning propeller of a water craft as it passes through of water. Massive losses in financial costs, loss of life and limb as well as harm being done to endangered marine species is reduced through the use of a propeller deflector system. Improved handling and lateral stability benefits are achieved with the increased vertical surfaces of the propeller deflector vanes passing through the water. A sensor able to detect objects near the path of the boat controls the power source to the propeller. No direct response is required of the boat operator as all responses to signals received by the sensing system are automatic.

ITEM LISTING KEY

Figure 1A:
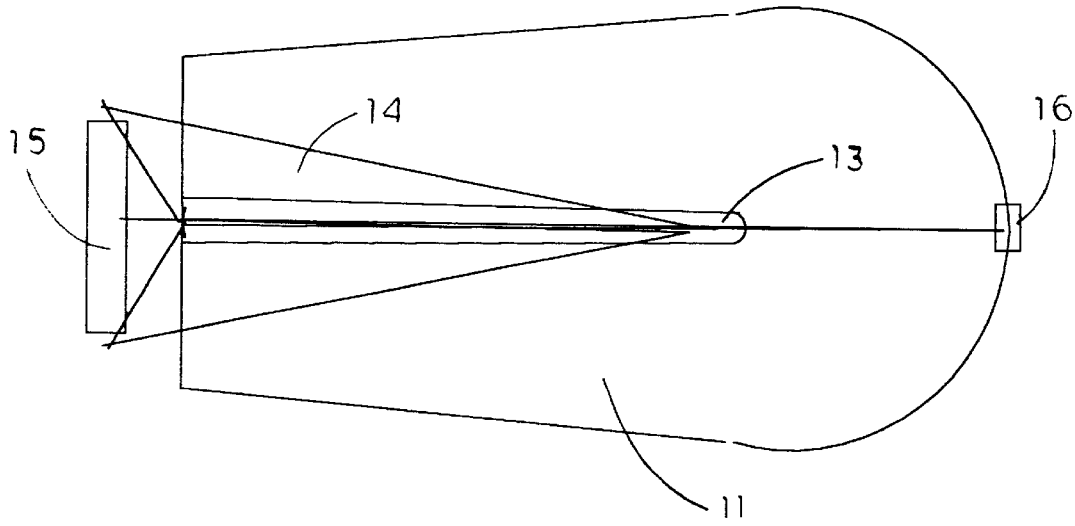
FIG. 1A—Presents a bottom view of the overall concept of units mounted on hull.
Figure 1B:
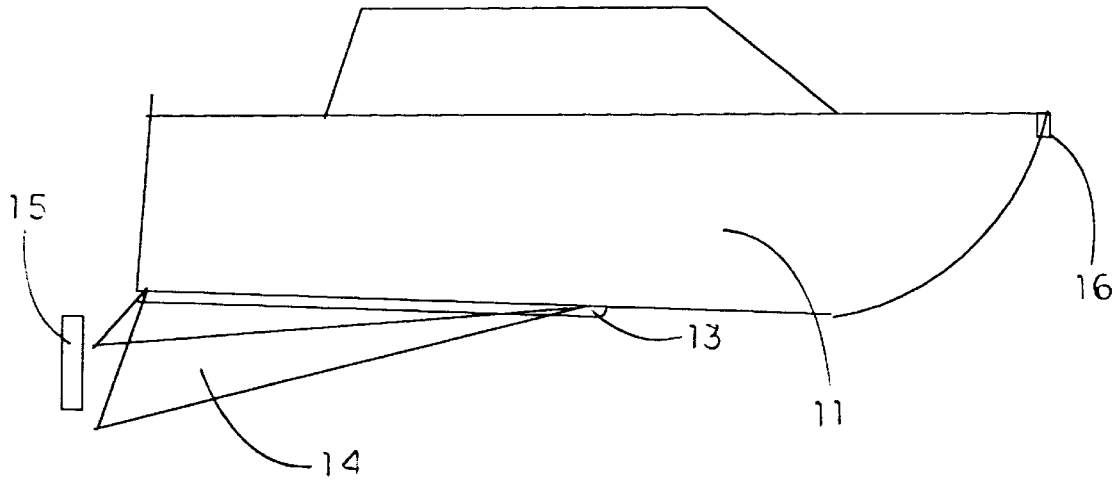
FIG. 1B—Side view of a typical system as mounted on hull.
Figure 2A:
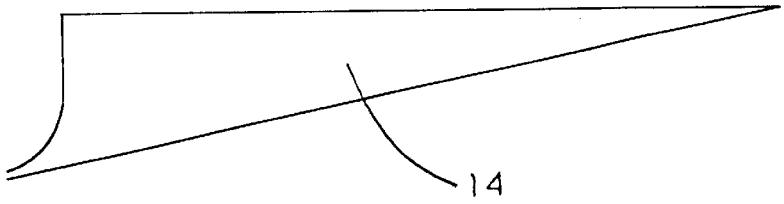
FIG. 2A—Stern view depicting relationship of the vanes to a propeller.
Figure 2B:
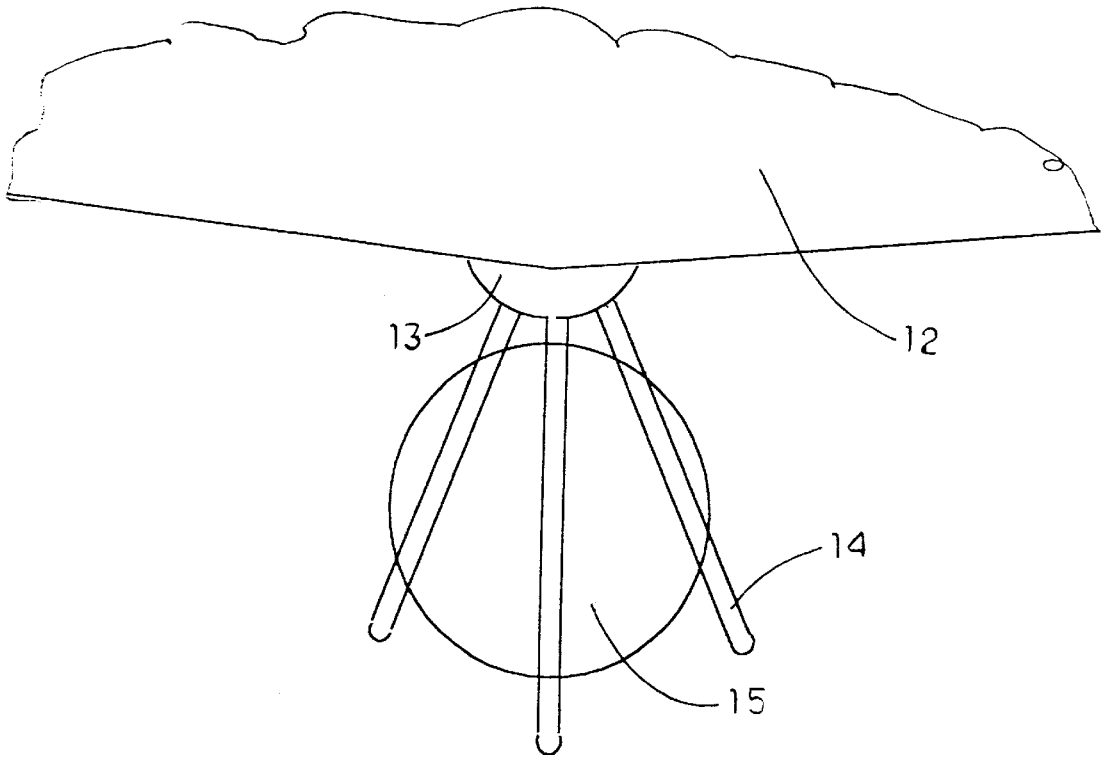
FIG. 2B—Stern view showing typical multiple propeller installation.

Item 11—Outline of a typical boat hull

Item 12—Vane mounting main member.

Item 13—Typical main vane as attached to mounting base.

Item 14—Propeller.

Item 15—Mounting attachment materials.

Item 16—Forward looking sensing device.

DESCRIPTION OF THE INVENTION

The propeller deflector is a system comprising a series of rigid vanes, each aligned parallel to the longitudinal axis of the boat and permanently attached to the bottom of the hull.

The vanes extend outward from a main mounting member in a radial fashion likened to feathers on the shaft of an arrow. Similar systems can be incorporated into the hulls of new boats during the manufacturing process. The inclined surfaces force items such as people, animal life and debris away from contact with a rotating marine propeller as it passes through the water. The propeller deflector has the ability and structural integrity to force the water craft itself away from fixed or large objects capable of doing structural damage to the craft.

A sensing device detects items in the path of the water craft acts to disconnect or stop the driving forces to the propeller to further reduce harm or damage.

Operation: As the boat moves through the water, objects such as human or animal life and debris slide along the edge of the deflector vanes and are pushed out of the range of the spinning propeller. No action is required on the part of the craft operator to enable the system to function. Sensing devices detecting objects in the path of the boat automatically disconnect the driving linkage and signal the power source to shut down.

The advantages of the propeller deflector system include the potential for increased stability of the craft during its operation. The vertical surface area provides greater lateral control and a reduction in unwanted side movement.

The gradual incline and smooth surfaces of the deflector vanes force objects to slide along the edge and be directed away from harm and out of the range of the spinning propeller The structural integrity of the propeller deflector will force the hull of the water craft away from fixed or large objects and prevent or reduce damage to the craft and its propulsion system. Power sources to the propeller are disconnected or shut down when sensors detect objects in the path of the boat.that may be harmed or do damage to the structure of the boat or its driving system.

A propeller protector is a system comprising of rigid vanes (13), (12) an object sensing device with its related operating elements, (15) all designed to force items from the range of a spinning marine propeller. Rigid inclined vanes are permanently mounted on the bottom of the hull aligned parallel with the longitudinal axis of the water craft and in line with the propeller or propellers. The mounting system for the rigid vanes consists of a primary member anchored over the keel of the boat or elsewhere in line with the propeller or propellers with the vanes extending radially from that primary member like feathers extending from the shaft of an arrow. The inclined vanes are shaped and mounted flush and smooth with the primary member at the front end and gradually deepen in depth toward the rear end to a dimension that is beyond the arc of the propeller.

The number and size of the rigid vanes varies according to the diameter of the propeller or propellers and the size and shape of the boat hull. A sensing device detects objects in the water near the path of the boat. The sensing device stops transmission of power to the propeller by halting the flow of fuel, interrupting ignition or disconnecting the drive linkage to the propeller. Responses generated by the sensing device are automatic and no action is required on the part of the boat operator. The propeller deflector structure may be adapted and incorporated into a new hull during the process of fabrication. The materials for the fabrication of the structures are limited only be the requirement that they be water resistant and possess sufficient physical integrity to accomplish the designed purpose. Colors, sizes and shapes are variable, limited only by the shape and design of the hull to which they are attached.

While the above description contains many specific terms, these are not indicative of a limitation of the scope of this invention. Rather, it is exemplary of one embodiment of the scope of utility and benefits of this system and its components. This system may also serve in a manner where it is incorporated into the hull of a water craft to enhance the structural integrity of the hull during manufacture.

The propeller protector is a system used for directing human and animal life and debris away from contact with a spinning marine propeller. It comprises three basic elements: 13, A series of rigid vanes attached to the bottom of the hull of a water craft; 16, A sensing device to control the interruption of power to the propeller by either disconnecting the drive linkage, interrupting ignition or halting fuel flow to the power source and; 15, All items used for attachment to the structure of a boat. The gradually inclined design of the main vanes allows objects to slide along said vanes and be forced away from the propeller in a manner to reduce injury or damage to either the object or the structure and driving mechanism of the boat.

Additionally, the scope of this invention shall include the use of other materials and colors for the production of the components as well as variations of their size and shape as necessary to better accomplish assigned tasks.

Accordingly, the scope of the invention should be determined, not within the limits of the illustrations but moreso by the appended claims, their similar usages and any legal equivalents.

I claim:

1. A propeller deflector system comprising:

a) rigid inclined vanes adapted to be permanently mounted on the bottom of a hull of a watercraft and aligned parallel with the longitudinal axis of said watercraft, wherein said vanes extends below a propeller and beyond an arc of the propeller, and b) a sensing device adapted to detect objects in water near a path of said watercraft and controlling a power source to the propeller;

c) wherein the deflector system is mounted using a mounting system including a primary member anchored over a keel of the watercraft, the vanes extending radially outwardly from the primary member;

d) said primary mounting member has a front end and a rear end, wherein the vanes are flush and smooth with the primary member at the front end and extend in width toward the rear end;

e) wherein the front end is arranged to be positioned on the watercraft forward of the rear end;

f) the length of the primary member, from said rear end to said front end, being at least substantially half the length of the bottom of the hull.

2. The propeller deflector system of claim 1, wherein the number and size of said rigid vanes are adapted according to the diameter of the propeller or a size and shape of said hull and said watercraft.

3. The propeller deflector system of claim 1, wherein said sensing device stops transmission of power to said propeller in a manner selected from the group consisting of: halting the flow of fuel to said propeller, interrupting ignition of said propeller, and disconnecting a drive linkage to said propeller.

4. The propeller deflector system of claim 3, wherein a response generated by said device is automatic, requiring no action by a watercraft operator.

5. The propeller deflector system of claim 1, wherein said deflector system is adapted to be mounted on the hull during the process of fabrication of said hull.

6. The propeller deflector system of claim 1, wherein said vanes provide improved handing and lateral stability to said watercraft.

* * * * *